US009194071B2

(12) United States Patent
Seo et al.

(10) Patent No.: US 9,194,071 B2
(45) Date of Patent: Nov. 24, 2015

(54) PULSATOR DEVICE FOR WASHING MACHINES AND WASHING MACHINE HAVING THE SAME

(75) Inventors: Dong Pil Seo, Suwon-si (KR); Sang Yeon Pyo, Suwon-si (KR); Jae Ryong Park, Hwaseong-si (KR); Sung Hoon Kim, Seongnam-si (KR); Chang Ho Cho, Suwon-si (KR); Hyun Dong Jung, Seoul (KR); So Jung Yu, Hwanseong-si (KR); Ji Yu Lee, Incheon (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 1245 days.

(21) Appl. No.: 13/064,764

(22) Filed: Apr. 13, 2011

(65) Prior Publication Data

US 2011/0296876 A1 Dec. 8, 2011

(30) Foreign Application Priority Data

Jun. 7, 2010 (KR) ..... 10-2010-0053391

(51) Int. Cl.
*D06F 13/00* (2006.01)
*D06F 13/08* (2006.01)
*D06F 17/10* (2006.01)

(52) U.S. Cl.
CPC ..... *D06F 13/08* (2013.01); *D06F 17/10* (2013.01)

(58) Field of Classification Search
CPC ..... D06F 17/06; D06F 17/10; D06F 13/08; D06F 37/225; D06F 13/00
USPC ..... 68/133, 134, 131, 23.2, 23.6, 212, 53, 68/142, 23.7; 312/228
See application file for complete search history.

(56) References Cited

U.S. PATENT DOCUMENTS

| | | | | |
|---|---|---|---|---|
| 5,850,750 | A | 12/1998 | Cho | |
| 5,921,114 | A | 7/1999 | Jung | |
| 5,950,460 | A | 9/1999 | Oh | |
| 6,332,343 | B1 * | 12/2001 | Koketsu et al. | 68/23.7 |
| 7,213,423 | B2 * | 5/2007 | Lim et al. | 68/23.2 |
| 2003/0154749 | A1 * | 8/2003 | Kim et al. | 68/23.6 |
| 2004/0031294 | A1 * | 2/2004 | Lim et al. | 68/23.2 |

FOREIGN PATENT DOCUMENTS

| | | | |
|---|---|---|---|
| CN | 1438379 | A | 8/2003 |
| CN | 1475620 | | 2/2004 |
| CN | 1940329 | A | 4/2007 |
| CN | 101792961 | | 8/2010 |
| EP | 2248934 | A1 | 11/2010 |
| EP | 2314747 | A1 | 4/2011 |

(Continued)

OTHER PUBLICATIONS

European Search report dated Oct. 20, 2011 issued in corresponding European Patent Application 11163827.6.

(Continued)

*Primary Examiner* — Michael Barr
*Assistant Examiner* — Thomas Bucci
(74) *Attorney, Agent, or Firm* — Staas & Halsey LLP

(57) ABSTRACT

A pulsator device in which a second pulsator performs different movements according to rotating directions of a first pulsator so as to reduce water consumption and improve washing performance.

20 Claims, 16 Drawing Sheets

(56) References Cited

FOREIGN PATENT DOCUMENTS

| | | |
|---|---|---|
| JP | 60-7897 | 1/1985 |
| KR | 10-2004-0034235 | 4/2004 |
| WO | 00/06819 | 2/2000 |

OTHER PUBLICATIONS

Chinese Office Action dated Jun. 5, 2014 in corresponding Chinese Patent Application No. 201110135884.8.

Chinese Office Action dated Jan. 21, 2015 issued in corresponding Chinese Application No. 201110135884.8.

* cited by examiner

PULSATOR DEVICE FOR WASHING MACHINES AND WASHING MACHINE HAVING THE SAME

CROSS-REFERENCE TO RELATED APPLICATIONS

This application claims the benefit of Korean Patent Application No. 2010-0053391, filed on Jun. 7, 2010 in the Korean Intellectual Property Office, the disclosure of which is incorporated herein by reference.

BACKGROUND

1. Field

Embodiments relate to a washing machine having a pulsator device generating complex water currents.

2. Description of the Related Art

In general, a washing machine employing a pulsator washes laundry using a water current generated due to rotation of the pulsator.

In order to improve washing ability of the washing machine, the pulsator needs to generate a strong water current. However, when the pulsator generates the stronger water current, the possibility of damaging the laundry increases.

Performance of the washing machine is basically determined by the washing ability, but if the laundry is damaged during a washing process, excellent washing ability does not provide a favorable impression to users.

On the other hand, an amount of water consumed during washing is an important factor determining the performance of the washing machine.

If the amount of water consumed during washing increases, a long time is taken to carry out supply and drainage of water, thereby being uneconomical as well as elongating a washing time.

SUMMARY

Therefore, it is an aspect to provide a pulsator device which generates complex water currents so as to improve performance of a washing machine.

Additional aspects of the invention will be set forth in part in the description which follows and, in part, will be apparent from the description, or may be learned by practice of the invention.

In accordance with one aspect, a pulsator device for washing machines includes a first pulsator rotated around a rotary shaft, a shaft fixed to the first pulsator so as to revolve around the rotary shaft, and rotated together with rotation of the first pulsator, and a second pulsator rotatably connected to the shaft, wherein the shaft is disposed so as to have a biaxial inclination angle structure in the X-axis direction and the Y-axis direction with respect to an X-Y plane perpendicular to the rotary shaft.

The shaft may be disposed at a position eccentric from the rotary shaft to one side, and be inclined upward toward the outside in the radial direction of the first pulsator.

The first pulsator may include a recess formed on the upper portion thereof, and the second pulsator may be disposed in the recess.

The recess may be eccentrically disposed at one side in the radial direction of the first pulsator, and an upper end of a side wall forming the recess may be disposed adjacent to the outer circumferential surface of the second pulsator.

The pulsator device may further include a connector fixed to the upper surface of the first pulsator so as to be rotated together with rotation of the first pulsator, the connector may include an inclined plane perpendicular to the shaft, and the shaft may be extended so as to be perpendicular to the inclined plane.

The pulsator device may further include a clutch unit to intermit rotation of the second pulsator relative to the shaft according to a rotating direction of the second pulsator.

The clutch unit may include a clutch spring which is wound and unwound according to the rotating direction of the second pulsator.

The clutch unit may include a one-way clutch installed between the shaft and the second pulsator so as to cause the second pulsator to be rotated in any one direction out of the clockwise direction and the counterclockwise direction.

The clutch unit may include a latch structure to restrict rotation of the second pulsator, if the second pulsator is rotated in a first direction, and to allow the second pulsator to be rotated, if the second pulsator is rotated in an opposite direction to the first direction.

The latch structure may include at least one latch protrusion, and at least one forward and backward moving member supported by an elastic member and moving forwards and backwards, and the latch structure may restrict rotation of the second pulsator through latching of the at least one forward and backward moving member to the at least one latch protrusion, if the second pulsator is rotated in the first direction, and release the restriction of the second pulsator through application of pressure from the at least one latch protrusion to the at least one forward and backward moving member, if the second pulsator is rotated in the opposite direction to the first direction.

In accordance with another aspect, a washing machine includes a first pulsator rotated around a rotary shaft, a shaft inclined on the first pulsator so as to be rotated together with rotation of the first pulsator, a second pulsator rotatably connected to the shaft so as to be rotated in a first direction and in a second direction opposite to the first direction, and a clutch unit to intermit rotation of the second pulsator so as to cause the second pulsator to be rotated in any one direction out of the first direction and the second direction.

The shaft may be inclined with respect to the rotary shaft.

The shaft may be inclined upward toward the outside in the radial direction of the first pulsator.

The shaft may be disposed at a position eccentric from the center of rotation of the first pulsator.

The first pulsator may include a recess formed on the upper portion thereof and a side wall around the recess, and the second pulsator may be disposed in the recess.

The uppermost part of the side wall may be disposed adjacent to the uppermost part of the outer circumferential surface of the second pulsator inclined with respect to the horizontal direction.

The washing machine may further include a connector disposed between the first pulsator and the second pulsator, and fixed to the first pulsator so as to be rotated together with rotation of the first pulsator, the connector may include an inclined plane perpendicular to the shaft, and the shaft may be extended perpendicularly from the inclined plane.

The clutch unit may include a clutch spring wound so as to restrict rotation of the second pulsator, if the second pulsator is rotated in the first direction, and unwound so as to release the restriction of the second pulsator, if the second pulsator is rotated in the second direction.

The clutch unit may include a one-way clutch installed between the shaft and the second pulsator.

The clutch unit may include a latch structure including at least one latch protrusion, and at least one forward and backward moving member moving forwards and backwards by an elastic member, so that the at least one latch protrusion and the at least one forward and backward moving member restrict each other, if the second pulsator is rotated in the first direction, and release the restriction, if the second pulsator is rotated in the second direction.

In accordance with another aspect, a pulsator device for washing machines includes a first pulsator rotated around a rotary shaft in a regular direction and the reverse direction, and a second pulsator selectively rotated according to a rotating direction of the first pulsator.

The pulsator device may further include a shaft connected to the first pulsator so as to be rotated together with rotation of the first pulsator, and inclined, and the second pulsator may be rotatably connected to the shaft.

The pulsator device may further include a clutch unit to restrict rotation of the second pulsator relative to the shaft, if the first pulsator is rotated in any one direction out of the regular direction and the reverse direction.

The second pulsator may be rotated integrally with the first pulsator to perform a rotating movement, if the rotation of the second pulsator is restricted, and perform a wobbling movement during rotation of the first pulsator, if the restriction of the rotation of the second pulsator is released.

In accordance with a further aspect, a pulsator device for washing machines includes a first pulsator rotated around a rotary shaft, and provided with a plurality of planes formed on the upper surface thereof and inclined at different angles with respect to the horizontal plane, a plurality of recesses, each of which is formed on each inclined plane, a plurality of shafts, each of which is disposed on the bottom of each recess so as to have a biaxial inclination angle structure, and a plurality of second pulsators, each of which is rotatably provided on each shaft.

The plurality of second pulsators may be disposed so as to uniformly divide the upper surface of the first pulsator.

The pulsator device may further include a clutch unit connected to at least one of the plurality of shafts so as to intermit rotation of the second pulsator according to a rotating direction of the second pulsator rotatably connected to each shaft.

The clutch unit may include a clutch spring wound or unwound according to the rotating direction of the second pulsator.

The clutch unit may include a one-way clutch installed between the shaft and the second pulsator.

The clutch unit may include a latch structure including at least one latch protrusion, and at least one forward and backward moving member supported by an elastic member and moving forwards and backwards, and the latch structure may restrict rotation of the second pulsator through latching of the at least one forward and backward moving member to the at least one latch protrusion, if the second pulsator is rotated in a first direction, and release the restriction of the second pulsator through application of pressure from the at least one latch protrusion to the at least one forward and backward moving member, if the second pulsator is rotated in an opposite direction to the first direction.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
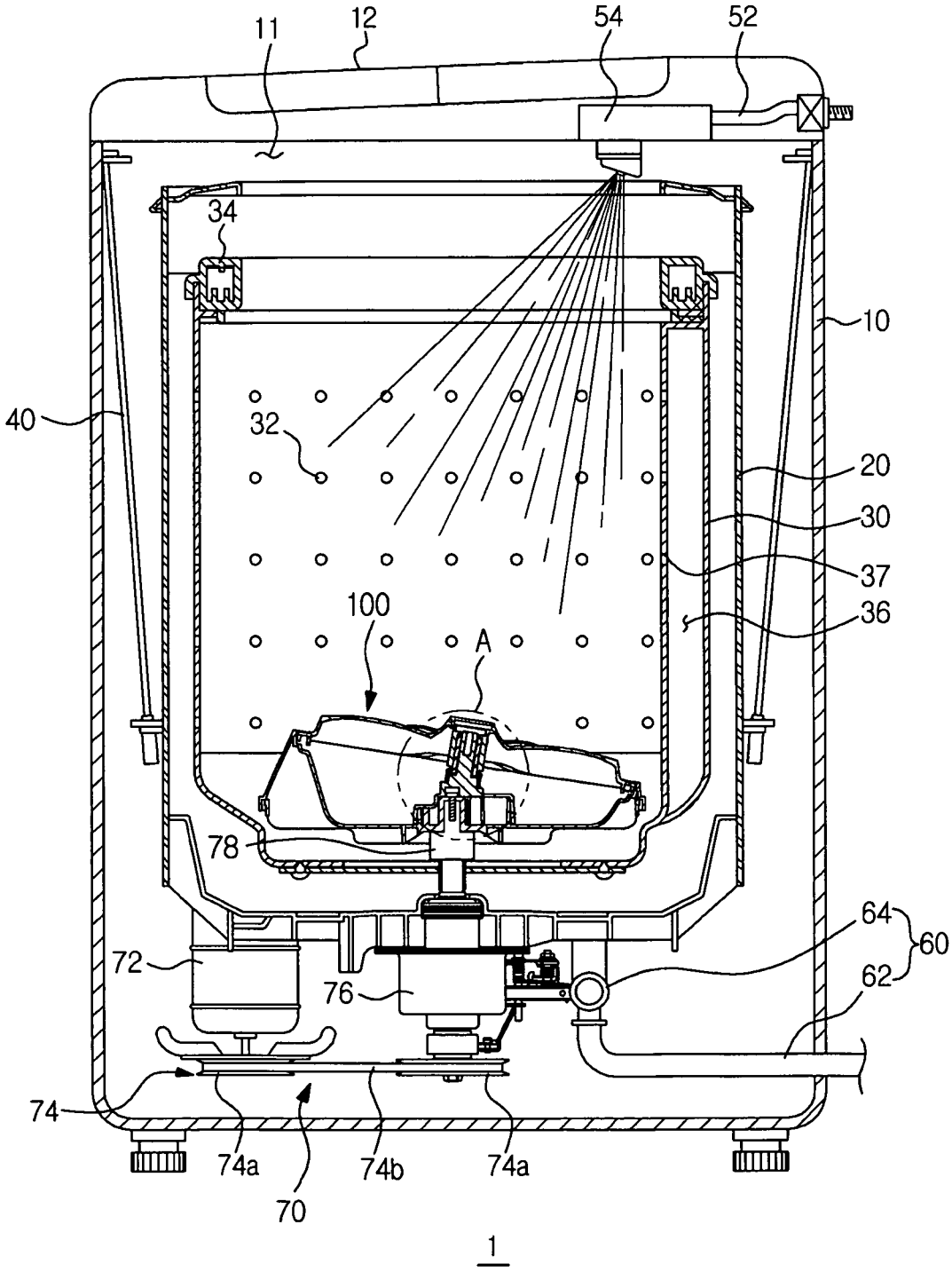
FIG. 1 is a longitudinal-sectional view illustrating a schematic structure of a washing machine in accordance with one embodiment.

Reference will now be made in detail to the embodiments, examples of which are illustrated in the accompanying drawings, wherein like reference numerals refer to like elements throughout.

FIG. 1 is a longitudinal-sectional view illustrating a schematic structure of a washing machine in accordance with one embodiment.

As shown in FIG. 1, a washing machine 1 includes a main body 10 forming an external appearance of the washing machine 1, a tub 20 disposed within the main body 10, a spin basket 30 rotatably disposed within the tub 20, and a pulsator device 100 disposed within the spin basket 30 to generate complex water currents.

An inlet 11 through which laundry is put into the spin basket 30 is formed through the upper surface of the main body 10, and the inlet 11 is opened and closed by a door 12 installed at the upper surface of the main body 10.

The tub 20 is supported by the main body 10 using suspension devices 40 connecting the lower portion of the outer surface of the tub 20 to the upper portion of the inner surface of the main body 10.

A water supply pipe 52 to supply wash water to the tub 20 is installed above the tub 20.

One end of the water supply pipe 52 is connected to an external water supply source (not shown), and the other end of the water supply pipe 52 is connected to a detergent supply device 54.

Water supplied through the water supply pipe 52 is supplied to the inside of the tub 20 together with a detergent via the detergent supply device 54.

A drain device 60 to discharge the wash water stored in the tub 20 to the outside of the washing machine 1 is installed under the tub 20.

The drain device 60 includes a drain pipe 62 connected to the lower portion of the tub 20, and a drain valve 64 installed on the drain pipe 62.

A drain pump (not shown) to forcibly discharge the wash water from the tub 20 is installed in the drain pipe 62.

The spin basket 30 is provided in a cylindrical shape, the upper surface of which is opened, and a plurality of dehydration holes 32 is formed through the side surface of the spin basket 30. A balancer 34 to allow the spin basket 30 to be stably rotated during high-speed rotation of the spin basket 30 is installed on the upper portion of the spin basket 30.

A pumping duct 36 to circulate the wash water in the spin basket 30 is installed on the inner surface of the spin basket 30, and discharge holes 37 to discharge the wash water are formed through the pumping duct 36.

A driving device 70 is installed under the tub 20. The driving device 70 includes a motor 72, a power transmission device 74, a clutch 76, and a drive shaft 78. The drive shaft 78 is connected with the pulsator device 100, and transmits power of the motor 72 to the pulsator device 100.

The power of the motor 72 is transmitted to the clutch 76 through the power transmission device 74. The power transmission device 74 includes pulleys 74*a*, and a belt 74*b* connecting the pulleys 74*a*. The clutch 76 intermits the power of the motor 72, thereby allowing the spin basket 30 and the pulsator device 100 to be rotated simultaneously, or the pulsator device 100 to be rotated while the spin basket 30 remains still.

Figure 2:
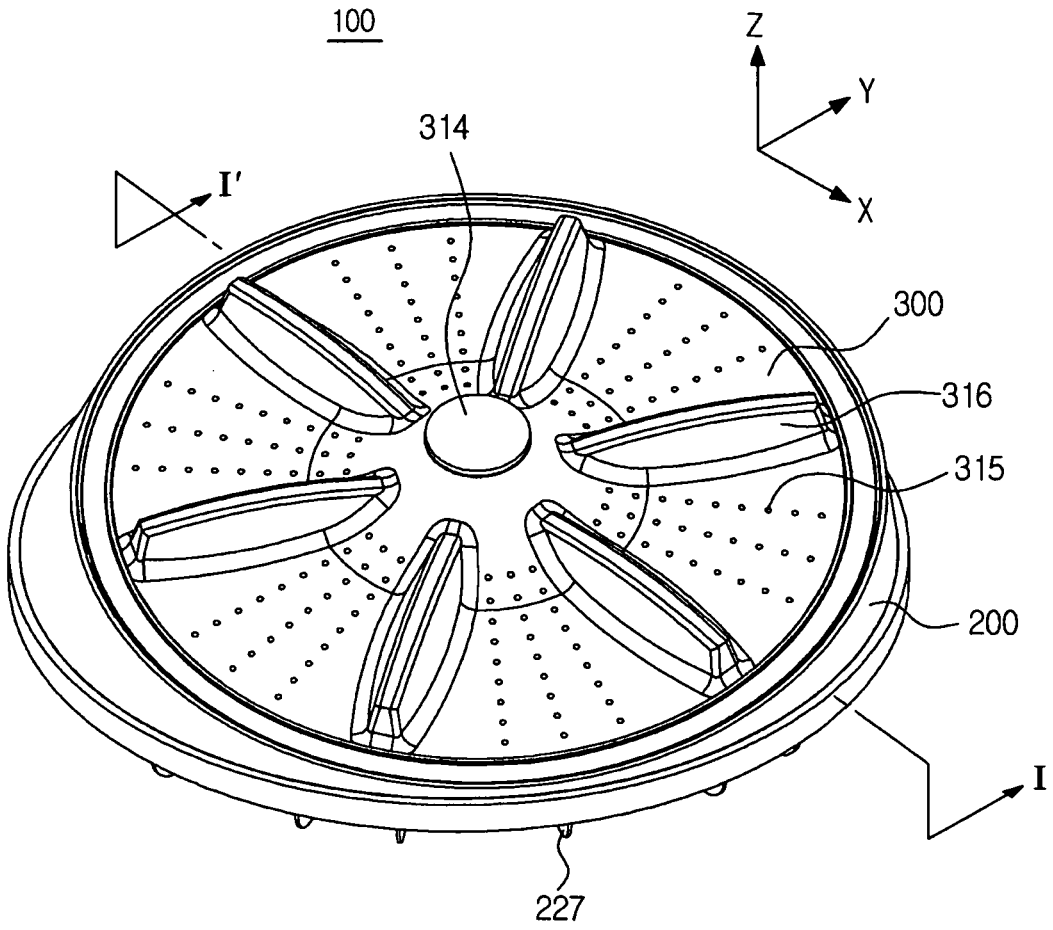
FIG. 2 is a perspective view of a pulsator device in an assembled state in accordance with the embodiment.
Figure 3:
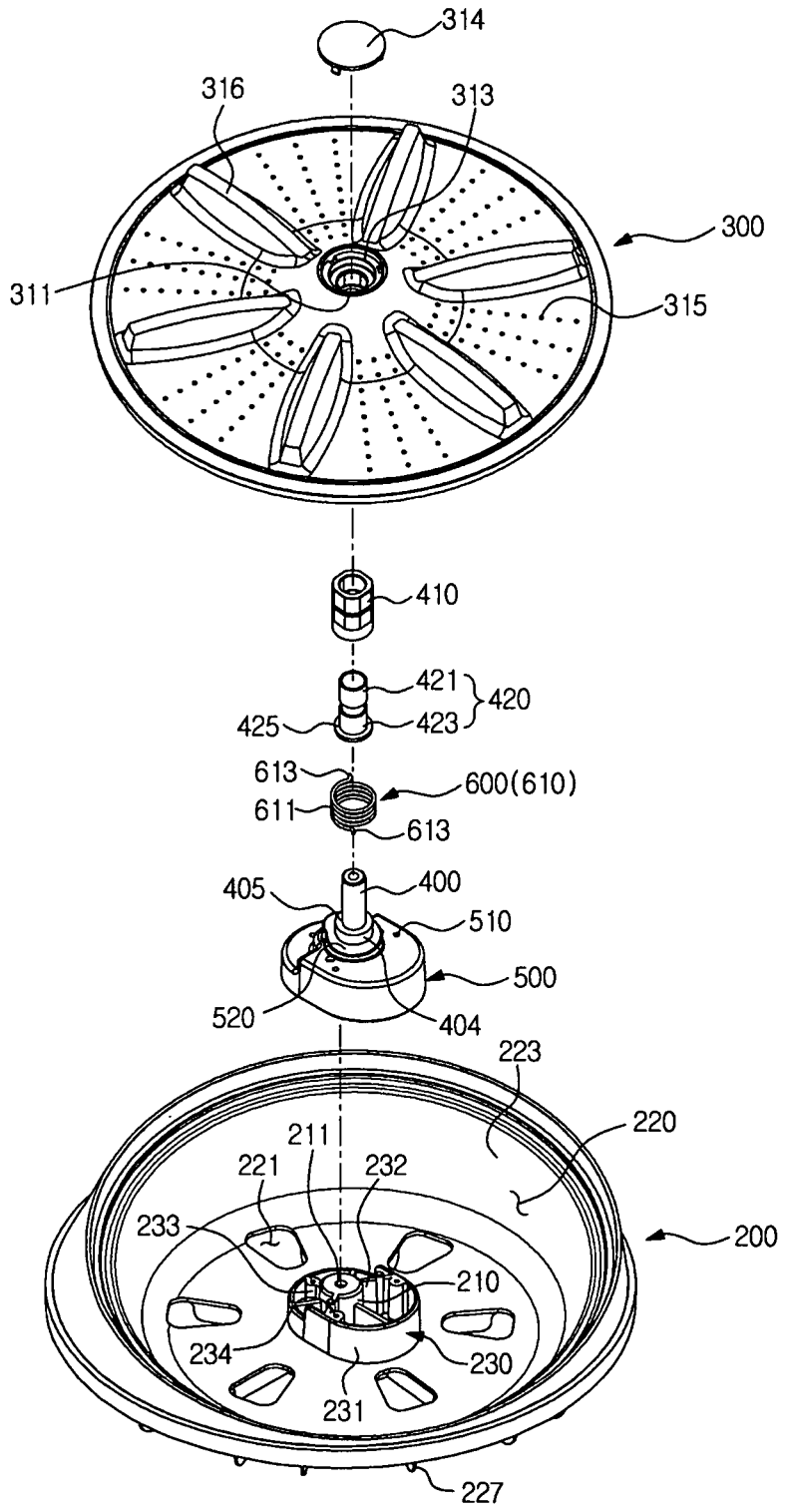
FIG. 3 is an exploded perspective view of the pulsator device in accordance with the embodiment.
Figure 4:
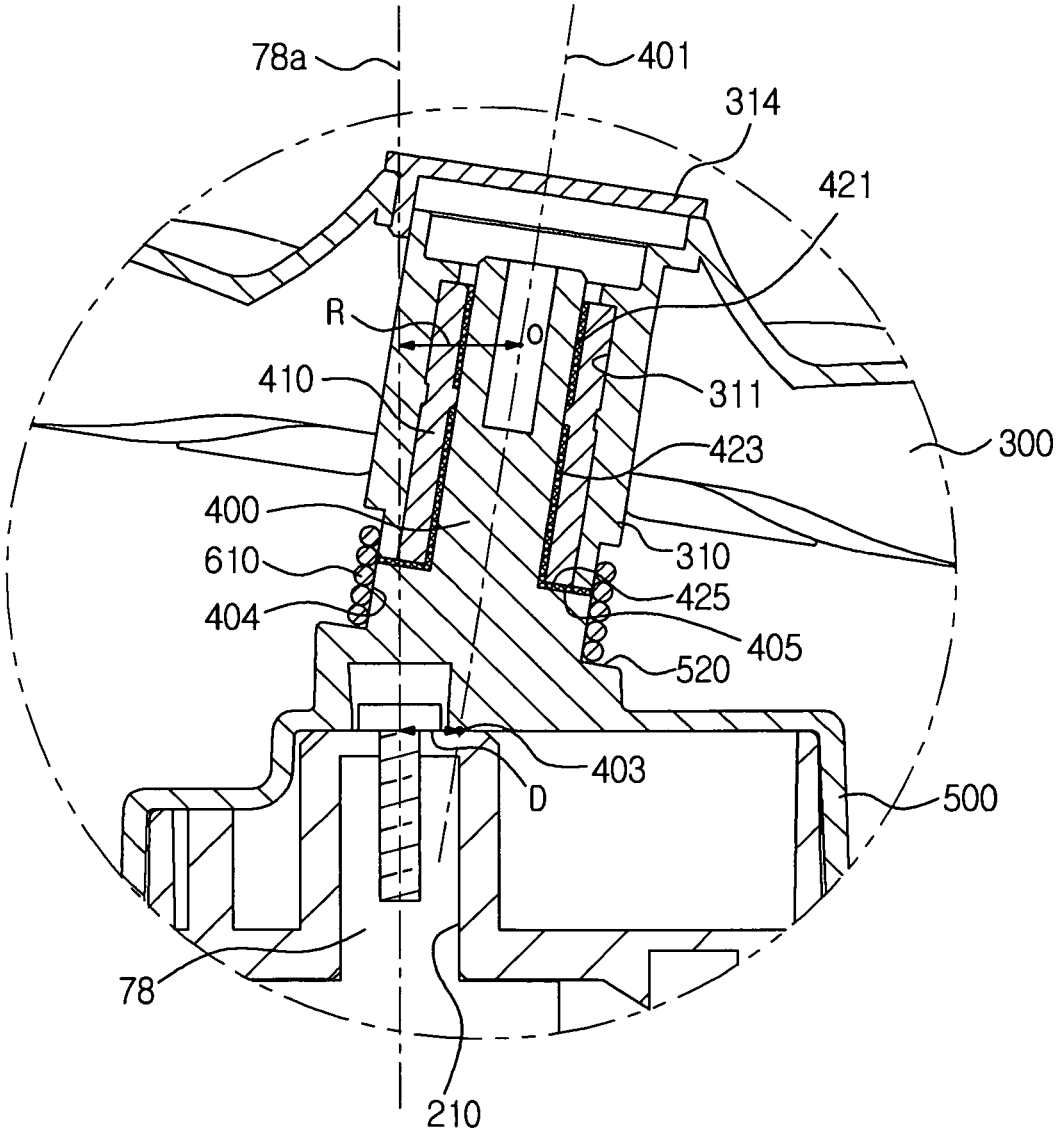
FIG. 4 is an enlarged view of the portion A of FIG. 1.
Figure 5A:
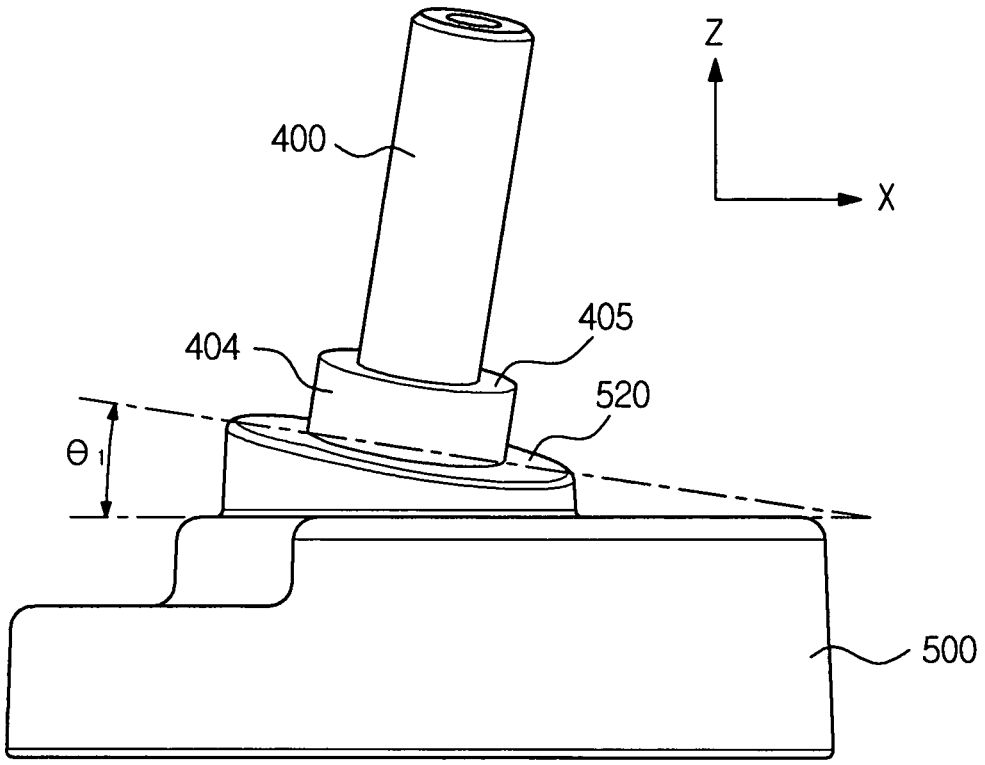
FIGS. 5A and 5B are views illustrating inclination angles of a shaft in accordance with the embodiment.
Figure 5B:
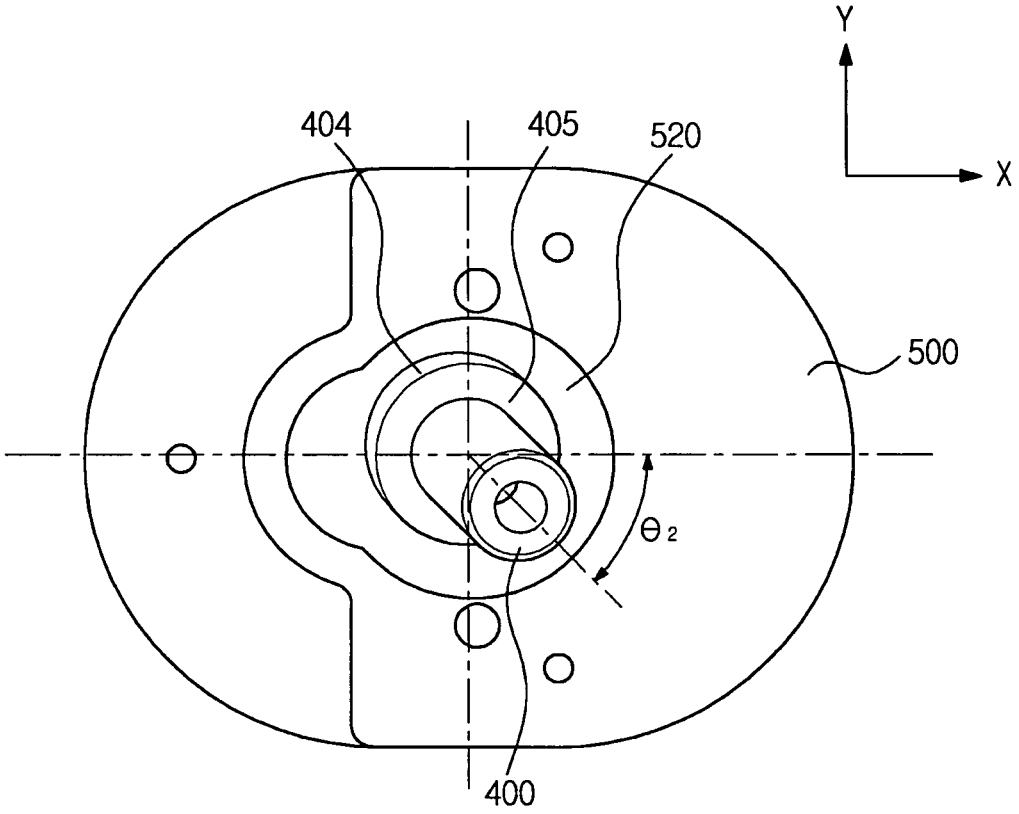

FIG. 2 is a perspective view of a pulsator device in an assembled state in accordance with the embodiment, FIG. 3 is an exploded perspective view of the pulsator device in accordance with the embodiment, FIG. 4 is an enlarged view of the portion A of FIG. 1, and FIGS. 5A and 5B are views illustrating inclination angles of the shaft in accordance with the embodiment.

With reference to FIG. 2, in order to describe directions in the embodiment, the X-axis direction (first direction), the Y-axis direction (second direction), and the Z-axis direction (third direction) are set. The Z-axis direction is a direction parallel with a direction of gravity, the X-axis direction is a direction perpendicular to the Z-axis direction, and the Y-axis direction is a direction perpendicular to the X-axis direction and the Z-axis direction.

Here, the X-axis direction means a first direction parallel with the leftward and rightward direction of the main body 10, and the Y-axis direction means a second direction parallel with the forward and backward direction of the main body 10.

With reference to FIGS. 1 to 4, the pulsator device 100 includes a first pulsator 200 to form a general horizontally rotating water current, a second pulsator 300 connected to the upper portion of the first pulsator 200 to form a wobbling water current which vertically flows and/or a rotating water current, and a shaft 400 connecting the first pulsator 200 and the second pulsator 300.

At least a part of the first pulsator 200 may be rotatably disposed on the bottom surface of the spin basket 30. The first pulsator 200 includes a shaft connection part 210 formed at the center thereof, and the drive shaft 78 of the driving device 70 is connected with the shaft connection part 210.

The drive shaft 78 functions as a rotary shaft of the first pulsator 200. When power of the motor 72 is transmitted to the drive shaft 78 through the clutch 76, the first pulsator 200 is rotated around the drive shaft 78.

The first pulsator 200 is provided with a space to receive the second pulsator 300 so as to prevent damage to laundry due to jamming of the laundry in the lower portion of the second pulsator 300 during a wobbling movement of the second pulsator 300.

For this purpose, a recess 220 is formed on the upper surface of the first pulsator 200, and a side wall 223 is formed around the recess 220. The recess 220 is disposed so as to be eccentric to one side in the radial direction of the first pulsator 200.

Holes 221 are disposed on the bottom of the recess 220 in the circumferential direction, and a plurality of pumping blades 227 is radially disposed on the rear surface of the first pulsator 200.

Therethrough, when laundry is washed, wash water around the first pulsator 200 is introduced to the rear surface of the first pulsator 200 through the holes 221 of the first pulsator 200, and is pressurized outwardly in the radial direction of the first pulsator 200 by the pumping blades 227.

The wash water pressurized by the pumping blades 227 is guided into the pumping duct 36 (with reference to FIG. 1) through a channel (not shown) formed on the lower portion of the spin basket 30, and is discharged to the inside of the spin basket 30 through the discharge holes of the pumping duct 36.

As shown in FIG. 4, the shaft 400 is fixed to the first pulsator 200 so as to revolve around an axis 78*a* of the drive shaft 78 during the rotation of the first pulsator 200.

For this purpose, an axis 401 of the shaft 400 is disposed at a position eccentric from the axis 78*a* of the drive shaft 78. That is, a point 403 where the axis 401 of the shaft 400 and the first pulsator 200 meet is disposed at a position separated from the axis 78*a* of the drive shaft 78 by a designated distance D.

Therefore, if the pulsator 200 is rotated together with rotation of the drive shaft 78, the shaft 400 fixed to the first pulsator 200 is rotated together with the rotation of the pulsator 200 while revolving around the axis 78*a* of the drive shaft 78. Hereinafter, a configuration of such a shaft 400 will be described in more detail.

The shaft 400 is fixed to the first pulsator 200 through a connector 500. For this purpose, a connector connection part 230 connected with the connector 500 is provided on the recess 220 of the first pulsator 200.

As shown in FIG. 3, the connector connection part 230 includes a guide rib 231 protruded from the bottom of the recess 220. The guide rib 231 serves both to guide a connection position of the connector 500 and to stably support the inner surface of the connector 500 under the condition that the connector 500 is connected with the connector connection part 230.

The shaft connection part 210 is disposed at the inside of the guide rib 231, and the shaft connection part 210 and the guide rib 231 are connected by reinforcing ribs 232.

A through hole 211 to connect the connector 500 and the drive shaft 78 is formed through the upper surface of the shaft connection part 210.

At least one fastening boss 233 is provided on the connector connection part 231, and a fastening hole 234 is formed on each fastening boss 233.

The connector 500 is disposed between the first pulsator 200 and the second pulsator 300, and is connected with the first pulsator 200 so as to be rotated together with rotation of the first pulsator 200. The connector 500 is fixed to the first pulsator 200 through fastening members, such as bolts.

For this purpose, the connector 500 includes connection holes 510 corresponding to the fastening holes 234 of the connector connection part 230 and the through hole 211 of the shaft connection part 210.

Although this embodiment illustrates that the connector 500 is formed as a separate part, the connector 500 is not limited thereto. That is, the shaft 400 and/or the connector 500 may be formed integrally with the first pulsator 200, or only the shaft 400 may be provided on the first pulsator 200.

As shown in FIGS. 3 and 4, the shaft 400 fixed to the connector 500 so as to be disposed at a position eccentric from the drive shaft 78 to one side is inclined with respect to the drive shaft 78. Thereby, the second pulsator 300 connected to the shaft 400 is inclined with respect to the horizontal direction, thus allowing a random position of the second pulsator 300 to move in the vertical direction during rotation of the first pulsator 200.

For this purpose, an inclined plane 520 which is inclined with respect to the horizontal direction is provided on the connector 500, and the shaft 400 is extended upwards so as to be perpendicular to the inclined plane 520.

The inclined plane 520 has a biaxial inclination angle structure having designated inclination angles in directions of the X-axis and the Y-axis, which form a right angle on an X-Y plane perpendicular to the drive shaft 78.

That is, the inclined plane 520 has a first inclination angle $\theta_1$ in the X-axis direction, as shown in FIG. 5A, and has a second inclination angle $\theta_2$ in the Y-axis direction, as shown in FIG. 5B.

Thereby, the shaft 400 extended so as to be perpendicular to the inclined plane 520 also has a biaxial inclination angle structure having designated inclination angles $\theta_1$ and $\theta_1$ in the X-axis direction and the Y-axis direction on the X-Y plane perpendicular to the drive shaft 78.

Therefore, the shaft 400 is disposed at a position eccentric from the drive shaft 78 by the designated distance D, and is inclined upwards in a direction being distant from the drive shaft 78, i.e., in a direction between the X-axis and the Y-axis.

The first inclination angle $\theta_1$ determines an ascending and descending range of the second pulsator 300 during the wobbling movement of the second pulsator 300, and the second inclination angle $\theta_2$ determines a contact area of the surface of the second pulsator 300 with laundry during the rotating movement of the second pulsator 300. A detailed description thereof will be given later.

Although this embodiment illustrates that the shaft 400 is inclined upward toward the outside in the radial direction of the first pulsator 200, the shaft 400 may be inclined upward toward the inside in the radial direction of the first pulsator 200, i.e., toward the drive shaft 78.

However, in terms of an increase in a distance from the center O of the second pulsator 300 rotatably connected to the shaft 400 to the axis 78*a* of the drive shaft 78, i.e., a revolving radius r of the second pulsator 300, the shaft 400 may be inclined upward toward the outside in the radial direction of the first pulsator 200. That is, a distance between the center of the first pulsator 200 and the center of the second pulsator 300 may be varied.

Further, although this embodiment illustrates that the shaft 400 is disposed on the inclined plane 520 of the connector 500, if the shaft 400 alone is formed on the upper surface of the second pulsator 300, the shaft 400 may be extended vertically from a position eccentric from the drive shaft 78 by the designated distance D and then be inclined so as to have both the first inclination angle $\theta_1$ in the X-axis direction and the second inclination angle $\theta_2$ in the Y-axis direction.

With reference to FIGS. 3 and 4, the second pulsator 300 is rotatably connected to the shaft 400. The second pulsator 300 is not restricted by the shaft 400 so that the second pulsator 300 and the shaft 400 may be rotated relative to each other.

A connection boss 310 having a shaft connection hole 311, into which the shaft 400 is inserted, is provided on the center of the second pulsator 300. The connection boss 310 is supported by a stepped plane 405 provided on the lower portion of the shaft 400 protruded from the inclined plane 520 of the connector 500. The stepped plane 405 is formed on the upper surface of a support boss 404 extended vertically from the inclined plane 520.

A bearing 420 is disposed between the inner surface of the shaft connection hole 311 and the shaft 400 so as to allow the second pulsator 300 to be smoothly rotated relative to the shaft 400.

A bearing housing 410 is fixed to the inside of the shaft connection hole 311, and the bearing 420 is fixed to the inner surface of the bearing housing 410. The bearing 420 may be an oilless bearing.

The bearing 420 includes an upper bearing 421 fixed to the upper portion of the bearing housing 410, and a lower bearing 423 fixed to the lower portion of the bearing housing 410. If the bearing 420 is divided into two bearings 421 and 423, as described above, assembly efficiency and accuracy of the bearing 420 are improved.

The lower bearing 423 is provided with a flange part 425 disposed between the lower surface of the connection boss 310 and the stepped plane 405 of the shaft 400. The flange part 425 allows the connection boss 310 of the second pulsator 300 to be smoothly rotated on the stepped plane 405 of the connector 500.

A cap receipt part 313 is provided on the upper surface of the connection boss 310 of the second pulsator 300, and a cap 314 is installed in the cap receipt part 313.

Through holes 315 to circulate wash water are formed through the second pulsator 300. Wash water around the second pulsator 300 is introduced into the lower portion of the second pulsator 300 through the through holes 315.

Blades 316 are protruded from the upper surface of the second pulsator 300. The blades 316 are disposed in the circumferential direction of the second pulsator 300. The blades 316 rub against laundry so as to allow the laundry to induce rotation of the second pulsator 300 (using the shaft 400 as a central axis).

If the second pulsator 300 is axially connected to the shaft 400, the second pulsator 300 is disposed so as to have a biaxial inclination angle structure with respect to the first pulsator 200 in the X-axis and the Y-axis directions.

If the second pulsator 300 is disposed so as to have the biaxial inclination angle structure with respect to the first pulsator 200, a contact area of the second pulsator 300 with laundry during rotation of the second pulsator 300 is greater than that of a second pulsator, disposed so as to have a mono-axial inclination angle structure with the first pulsator 200 in the X-axis or the Y-axis direction, with laundry during rotation of the second pulsator.

Therefore, if the second pulsator 300 is rotated integrally with the first pulsator 200, the second pulsator 300 functions as a blade of the first pulsator 200 and thus the first pulsator 200 does not require any separate blade to form a wash water current.

Figure 14:
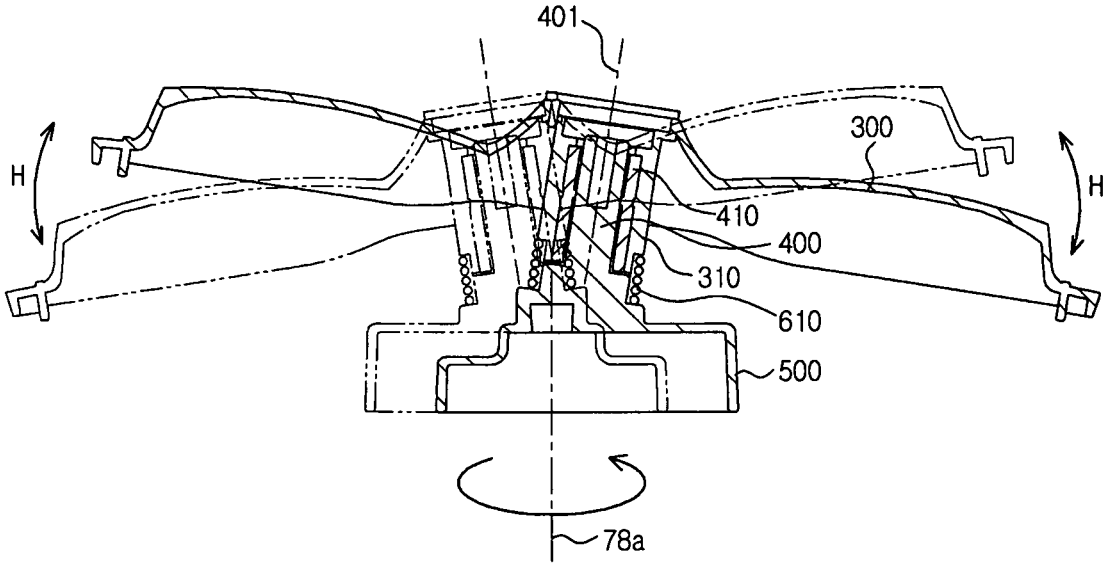
FIG. 14 is a longitudinal-sectional view illustrating an operating state of the second pulsator in accordance with the embodiment.

Since the second pulsator 300 is connected to the shaft 400 and is inclined, a random point on the upper surface of the second pulsator 300 moves in a revolving direction during rotation of the first pulsator 200. Further, the second pulsator rotatably connected to the shaft 400 is not restricted by the shaft 400, and thus is rotated relative to the shaft 400 due to friction with laundry. In this case, the random point on the upper surface of the second pulsator 300 moves in the vertical direction while revolving, thereby forming both a rotating water current and a water current in the vertical direction or the inclination direction. As shown in FIG. 14, during rotation of the first pulsator 200, the shaft 400 revolves around the axis 78*a* of the drive shaft 78, and if a weight of laundry is applied to the second pulsator 300, the second pulsator 300 is rotated and thus performs a rotating movement and a vertical movement (arrow H) due to the revolution of the shaft 400 and the rotation of the second pulsator 300.

Such a movement of the second pulsator 300 generates water currents in the rotating direction and the vertical direction within the spin basket 30.

Figure 6:
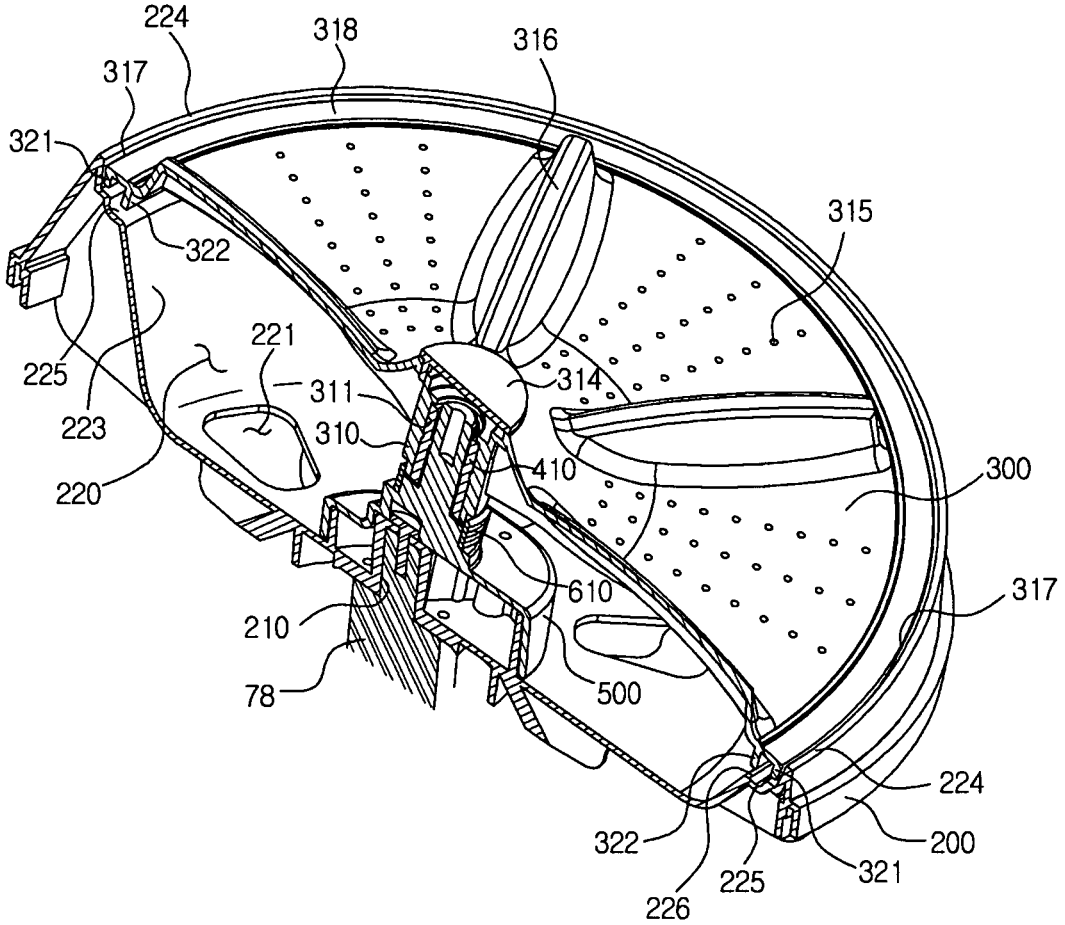
FIG. 6 is a longitudinal-sectional view taken along the line I-I' of FIG. 2.

FIG. 6 is a longitudinal-sectional view taken along the line I-I' of FIG. 2. As shown in FIG. 6, the side wall 223 forming the recess 220 of the first pulsator 20 is extended to a position adjacent to an outer circumferential surface 317 of the second pulsator 300 so as to reduce a gap between the first pulsator 200 and the second pulsator 300, if the second pulsator 300 is connected to the shaft 400. That is, an upper surface 318 adjacent to the outer circumferential surface 317 of the second pulsator 300 is smoothly connected with an upper end 224 of the side wall 223 without a great height difference.

The side wall 223 of the first pulsator 200 includes a step forming part 225 extended toward the inside in the radial direction of the first pulsator 200, and the second pulsator 300 includes at least one rib, i.e., ribs 321 and 322 in this embodiment, protruded from the edge of the second pulsator 300 toward the step forming part 225. The step forming part 225 and the ribs 321 and 322 prevent laundry or foreign substances from being jammed between the side wall 223 of the first pulsator 200 and the second pulsator 300.

The least one rib may include a first rib 321 adjacent to the side wall 223 of the first pulsator 200, and a second rib 322 disposed at the inside of the first rib 321 under the condition that the second rib 322 is separated from the first rib 321 by a designated interval.

In order to enhance a foreign substance introduction preventing function, a protrusion 226 is formed on the side wall 223 of the first pulsator 200. The protrusion 226 is adjacent to the first rib 321 and the second rib 322 of the second pulsator 300, and is protruded toward the second pulsator 300. The protrusion 226 may be protruded between the first rib 321 and the second rib 322 of the second pulsator 300.

Therethrough, although the second pulsator 300 received in the recess 220 eccentrically disposed on the first pulsator 200 is rotated, there is no gap between the upper end 224 of the side wall 223 and the outer circumferential surface 317 of the second pulsator 300, thereby preventing laundry from being jammed in the second pulsator 300.

Further, the upper end 224 of the side wall 23 forming the recess 220 of the first pulsator 200 may be higher than the upper surface 318 of the second pulsator 300.

The pulsator device 100 in accordance with this embodiment further includes a clutch unit 600 restricting rotation of the second pulsator 30 relative to the shaft 400 according to a rotating direction of the first pulsator 200.

With reference to FIGS. 3 and 4, the clutch unit 600 serves to intermit rotary force of the second pulsator 300 relatively rotatably connected to the shaft 400, and includes a clutch spring 610.

The clutch spring 610 is configured such that a central part 611 is wound plural times and a pair of ends 613 is protruded at different angles. A part of the central part 611 of the clutch spring 610 is fixed to the outer surface of the support boss 404 protruded from the inclined plane 520 of the connector 500, and the remaining part of the central part 611 of the clutch spring 610 is fixed to the outer surface of the connection boss 310.

That is, the clutch spring 610 is disposed concentrically with the support boss 404 and the connection boss 310, and thus is selectively tightened to the outer circumferential surfaces of the support boss 404 and the connection boss 310 according to a rotating direction of the connection boss 310, thereby contacting or being released from the support boss 404 and the connection boss 310.

Figure 7:
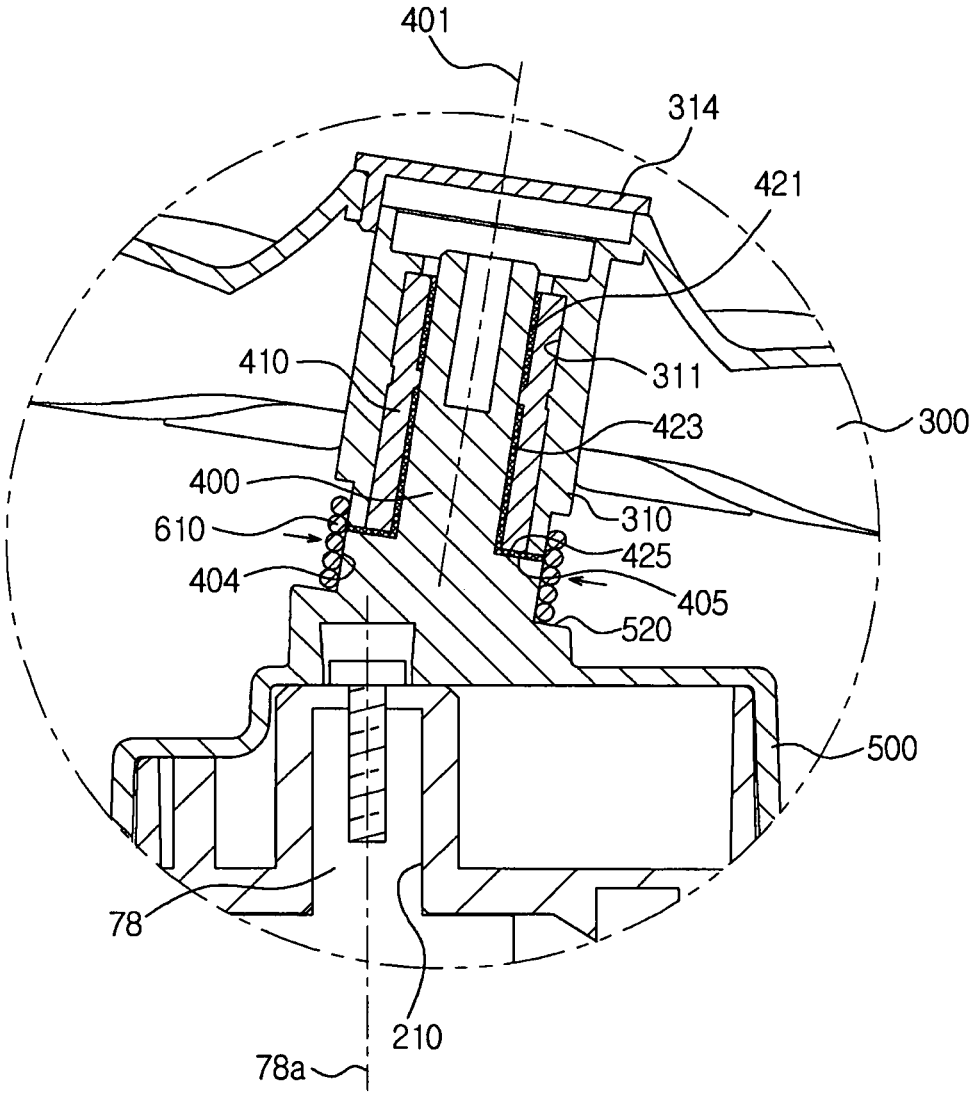
FIGS. 7 and 8 are views illustrating operation of a clutch spring in accordance with the embodiment.
Figure 8:
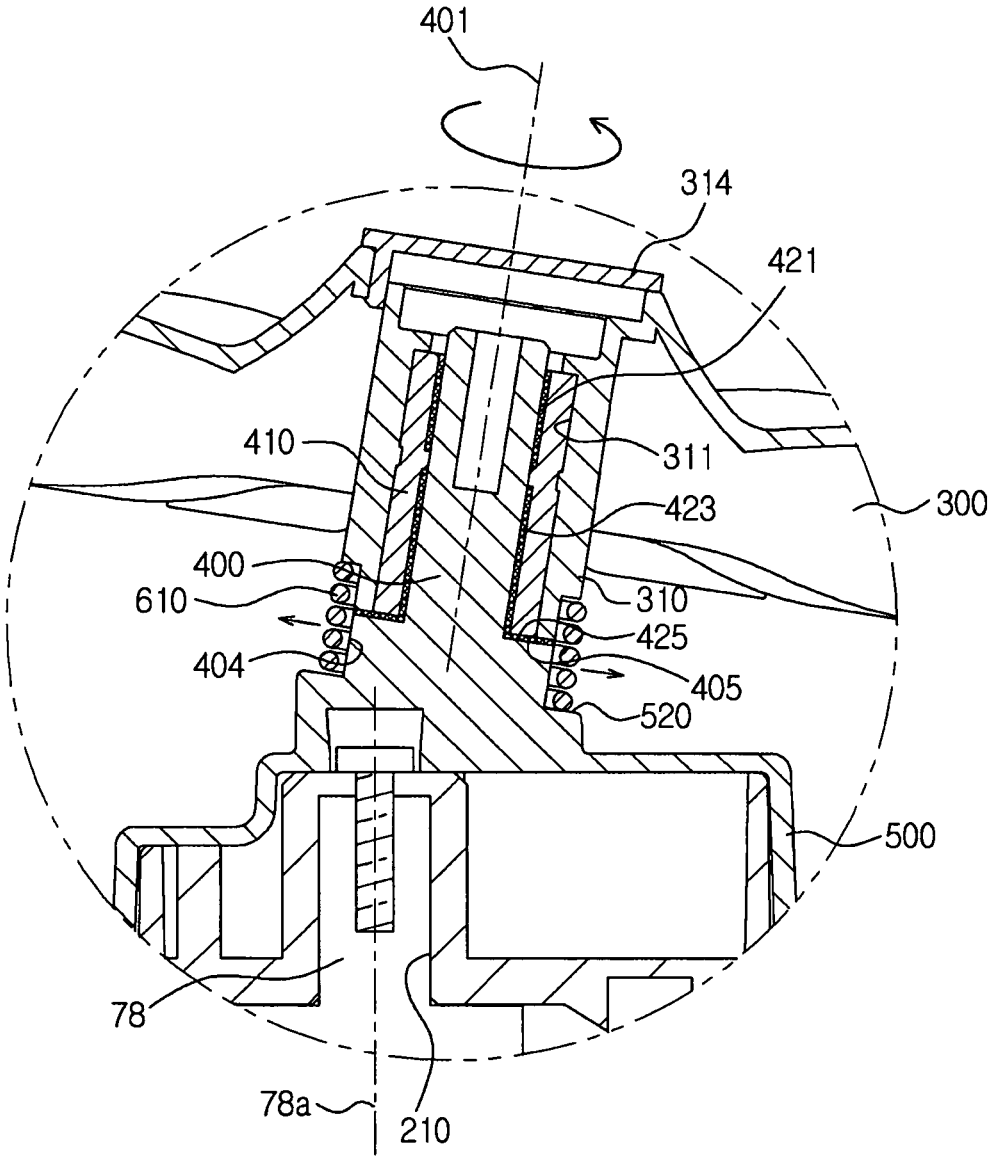

Thereby, if the second pulsator 300 is rotated in a direction of winding the clutch spring 610, as shown in FIG. 7, the clutch spring 610 firmly tightens the outer circumferential surfaces of the support boss 404 and the shaft 400 and thus the second pulsator 300 is not rotated around the shaft 400. On the other hand, if the second pulsator 300 is rotated in a direction of unwinding the clutch spring 610, as shown in FIG. 8, force enabling the clutch spring 610 to tighten the outer circumferential surfaces of the support boss 404 and the shaft 400 is decreased and thus the second pulsator 300 is rotated.

Although this embodiment illustrates that the outer circumferential surface of the connection boss 310 is fitted into the central part 611 of the clutch spring 610, such a connection position of the second pulsator 300 with the clutch spring 610 may be changed as long as the clutch spring 610 is connected to a part (for example, the bearing housing) which may restrict rotation of the second pulsator 300.

Figure 9:
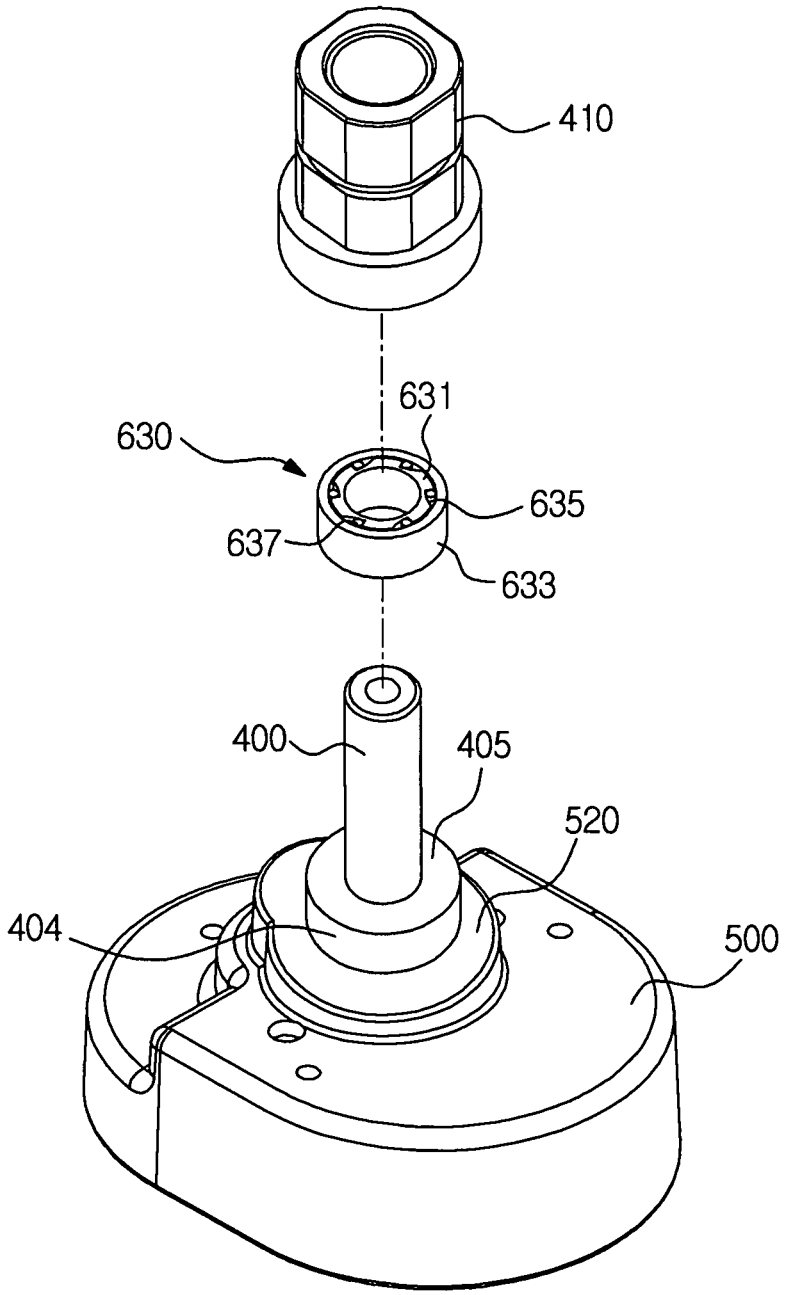
FIG. 9 is a perspective view illustrating a clutch unit in accordance with another embodiment.
Figure 10:
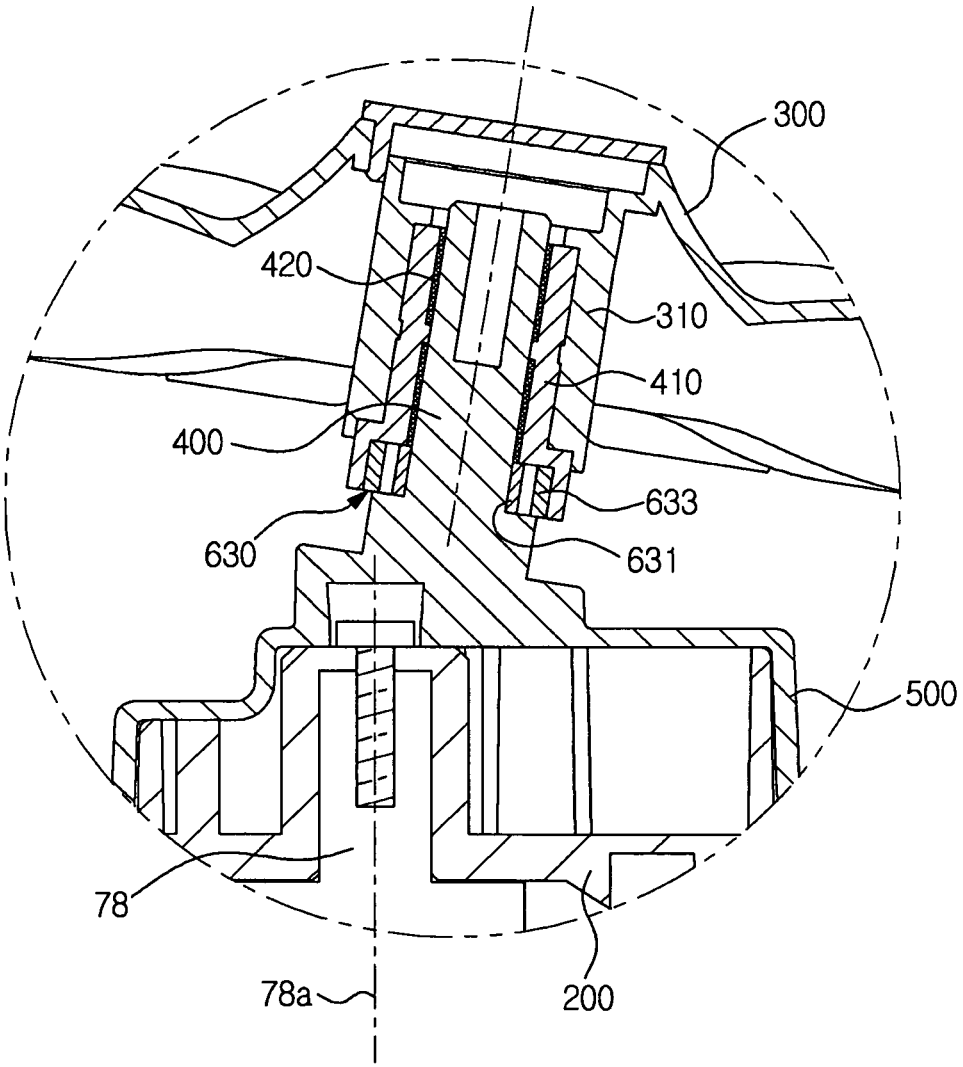
FIG. 10 is a longitudinal-sectional view illustrating an assembled state of the clutch unit of FIG. 9.
Figure 11:
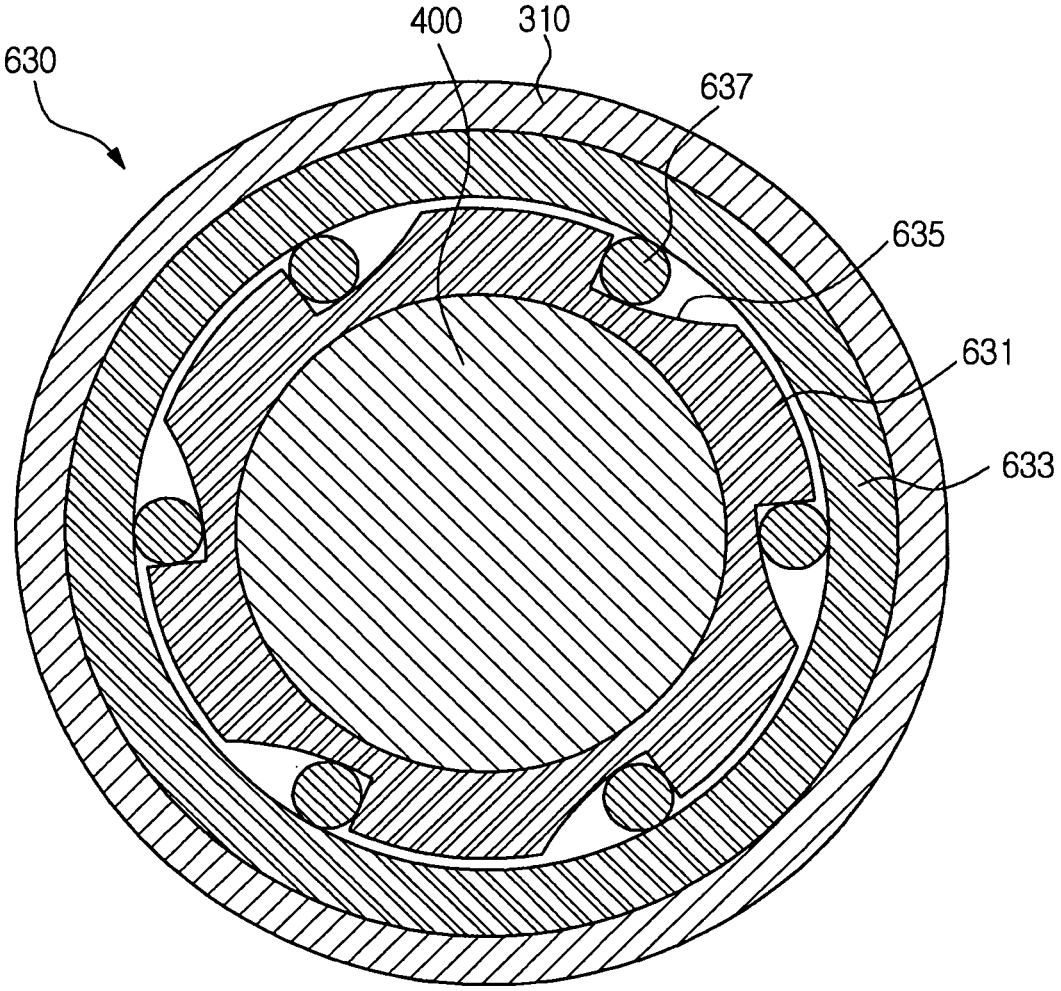
FIG. 11 is a transversal-sectional view of the clutch unit connected between a shaft and a bearing housing of FIG. 9.

FIG. 9 is a perspective view illustrating a clutch unit in accordance with another embodiment, FIG. 10 is a longitudinal-sectional view illustrating an assembled state of the clutch unit of FIG. 9, and FIG. 11 is a transversal-sectional view of the clutch unit connected between a shaft and a bearing housing of FIG. 9.

With reference to FIGS. 9 to 11, a second pulsator 300 is installed on a shaft 400 through a one-way clutch 630. Thus, the second pulsator 300 is provided such that it may be rotated in any one direction out of a first direction and a second direction.

Here, the first direction means any one of the clockwise direction and the counterclockwise direction, and the second direction means the other one of the clockwise direction and the counterclockwise direction.

In this embodiment, the one-way clutch 630 includes a first body 631 formed in a cylindrical shape, roller installation grooves 635 provided on the outer circumferential surface of the first body 631 and having a depth gradually increasing in the circumferential direction, roller bearings 637 installed in the roller installation grooves 635, and a second body 633 provided at the outside of the first body 631 and formed in a cylindrical shape.

The first body 631 is fixed to the outer circumferential surface of the shaft 400 by press fit, and the second body 633 is fixed to the inner circumferential surface of the bearing housing 410 by press fit.

Through such a configuration, the second pulsator 300 is rotated around the shaft 400 only when the second pulsator 300 is rotated in the first direction.

Although this embodiment illustrates that the second body 633 is fixed to the inner circumferential surface of the bearing housing 410 by press fit, the fixing method of the second body 633 to the bearing housing 410 is not limited thereto. That is, the second body 633 may be fixed to the inner circumferential surface of the connection boss 310, or the second body 633 may be formed integrally with the bearing housing 410 or the connection boss 310.

Further, although this embodiment illustrates the one-way clutch 630, other types of clutches may be used and, as needed, various types of one-way clutches may be used.

Figure 12:
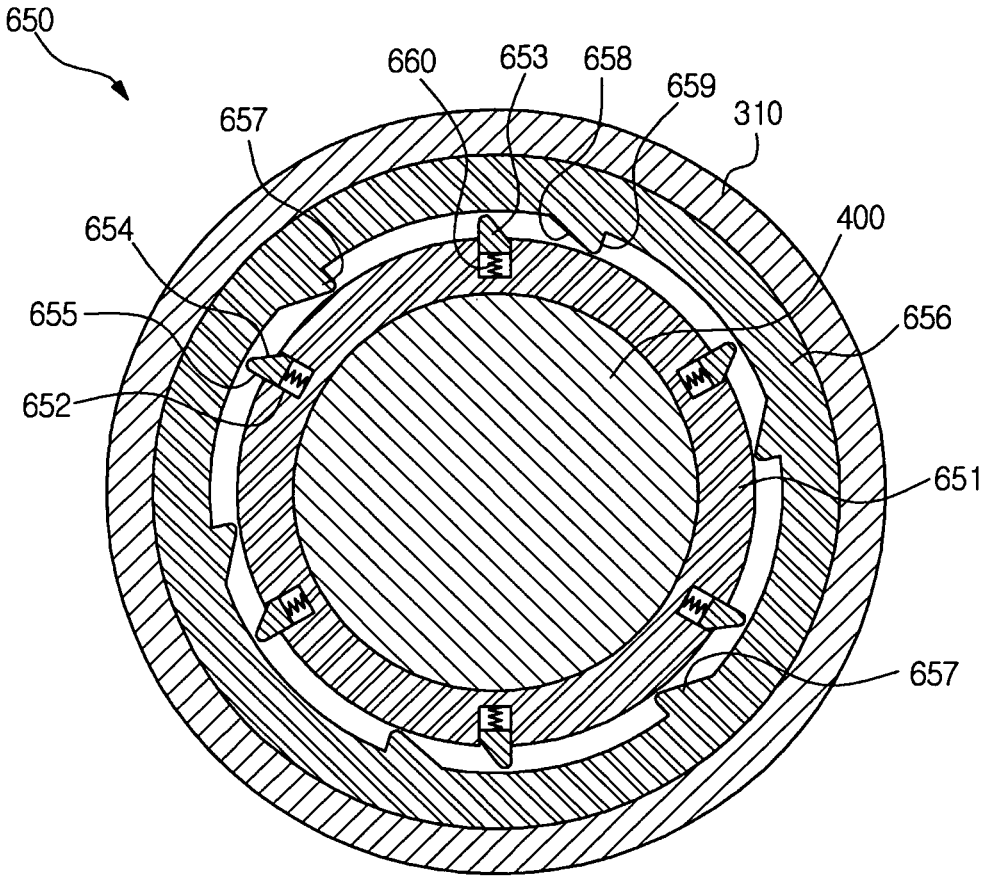
FIG. 12 is a transversal-sectional view of a clutch unit in accordance with another embodiment.

FIG. 12 illustrates a clutch unit in accordance with another embodiment.

A clutch unit 650 in accordance with this embodiment is formed in a latch structure. With reference to FIG. 12, the clutch unit 650 includes a first body 651 formed in a cylindrical shape, and a second body 565 having a greater diameter than that of the first body 651 and disposed at the outside of the first body 651.

The inner circumferential surface of the first body 651 is fixed to the outer circumferential surface of the shaft 400 by press fit, and the outer circumferential surface of the second body 656 is fixed to the inner circumferential surface of the connection boss 310 or the bearing housing 410.

At least one latch protrusion 657, separated in the circumferential direction, is provided on the inner circumferential surface of the second body 656, and at least one forward and backward moving member 653, which is movable forwards and backwards in the radial direction, is provided on the outer circumferential surface of the first body 651.

Each latch protrusion 657 includes a first guide part 658 inclined in the rotating direction (first direction) of the second body 656, and a first latch part 659 extended from the end of the first guide part 658 in the radial direction of the second body 656.

Each forward and backward moving member 653 includes a second guide part 654 corresponding to the first guide part 658 of the latch protrusion 657, and a second latch part 655 corresponding to the first latch part 659 of the latch protrusion 657.

Receipt parts 652, each of which receives the forward and backward moving member 653, are provided on the first body 651, and an elastic member 660 to elastically support the forward and backward moving member 653 is provided in each of the receipt parts 652.

Thereby, if the second body 656 is rotated in the first direction (clockwise direction), the first latch parts 659 of the latch protrusions 657 are restricted by the second latch parts 655 of the forward and backward moving members 653 and thus restrict rotation of the second body 656, and if the second body 656 is rotated in the second direction (counterclockwise direction), the first guide parts 658 of the latch protrusions 657 are guided by the second guide parts 654 of the forward and backward moving members 653 and thus apply pressure the forward and backward moving members 653 so as to enable smooth rotation of the second body 656.

Although this embodiment illustrates that the forward and backward moving members 653 are provided on the first body 651 and the latch protrusions 657 are provided on the second body 656, it would be appreciated by those skilled in the art that such positions of the forward and backward members 653 and the latch protrusions 657 may be interchanged without departing from the principles and spirit of the invention.

Further, although this embodiment illustrates that the clutch unit 650 of the latch structure includes the first body 651 and the second body 656 which are separately provided, it would be appreciated by those skilled in the art that the first body 651 may be formed integrally with the shaft 400 and the second body 656 may be formed integrally with the connection boss 310 or the bearing housing 410.

Hereinafter, operation of the pulsator device with the clutch unit will be described. Here, the clutch unit including the clutch spring is exemplarily described.

Figure 13:
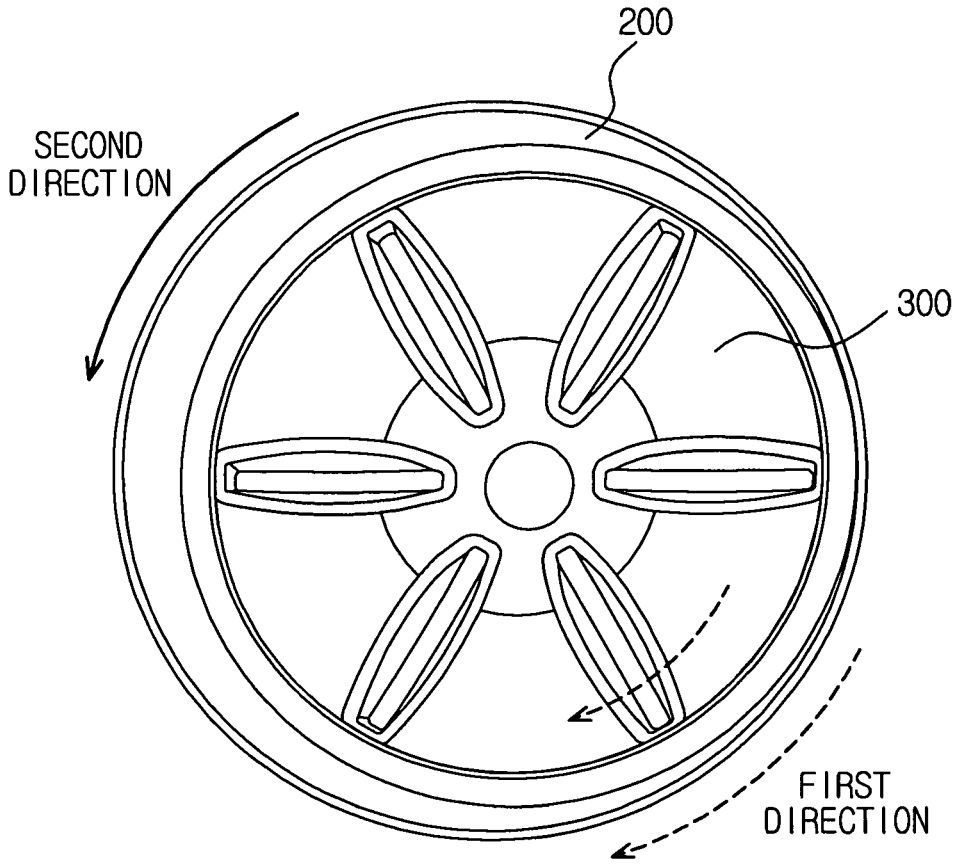
FIG. 13 is a view illustrating an operating state of a first pulsator and a second pulsator in accordance with the embodiment.

FIGS. 13 and 14 are views illustrating operation of a pulsator device of a washing machine in accordance with one embodiment. In this embodiment, the clutch spring 610 causing the shaft 400 to restrict rotation of the second pulsator 300 during rotation in the first direction (clockwise direction) and causing the shaft 400 to enable free rotation of the second pulsator 300 during rotation in the second direction (counterclockwise direction) will be exemplarily described.

When a user puts laundry into the spin basket 30, supplies a detergent into the detergent supply device 54 and then operates the washing machine 1, wash water is supplied to the inside of the spin basket 30 through the water supply pipe 52. When water supply is completed, the motor 72 is operated to drive the pulsator device 100.

Power of the motor 72 rotates the first pulsator 200 through the drive shaft 78. The first pulsator 200 is rotated in the first direction (clockwise direction) or in the second direction (counterclockwise direction) according to regular rotation or reverse rotation of the drive shaft 78, as shown in FIG. 13.

If the second pulsator 300 is rotated in the first direction, i.e., in a direction of winding the clutch spring 610, the clutch spring 610 tightens the support boss 404 and the connection boss 310, as shown in FIG. 7, and thereby, rotation of the second pulsator 300 about the shaft 400 is restricted and thus the first pulsator 200 and the second pulsator 300 restrict each other.

Therefore, the second pulsator 300 is rotated integrally with rotation of the first pulsator, thus performing a rotating movement without a vertical movement.

In this case, since the second pulsator 300 is disposed so as to have the biaxial inclination structure with respect to the first pulsator 200, the second pulsator 300 serves as a large blade of the first pulsator 200 during rotation of the first pulsator 200.

If the second pulsator 300 is rotated in the second direction, i.e., in a direction of unwinding the clutch spring 610, force enabling the clutch spring 610 to tighten the support boss 404 and the connection boss 310 is decreased and thus the connection boss 310 is freely rotated around the shaft 400.

Further, since the second pulsator 300 is disposed on the first pulsator 200 so as to be inclined with respect to the first pulsator 200, a random point on the upper surface of the second pulsator 300 moves in the vertical direction according to rotation of the first pulsator 200, and thereby a water current in the vertical direction is generated in the spin basket 30.

That is, as shown in FIG. 14, when the first pulsator 200 is rotated, the shaft 400 connected to the first pulsator 200 is rotated around the axis 78*a* of the drive shaft 78. At this time, when a weight of the laundry in the spin basket 30 is applied to the second pulsator 300, the second pulsator 300 moves while being rotated relative to the shaft 400. Therefore, the random point on the upper surface of the second pulsator 300 moves in the vertical direction, thus generating a water current in the vertical direction.

When the weight of the laundry is applied to the second pulsator 300, the shaft 400 moves while being rotating relative to the second pulsator 300, and thus the weight applied to the second pulsator 300 is not transmitted to the motor 72. Therefore, load applied to the motor 72 may be reduced.

As described above, the pulsator device 100 in accordance with this embodiment generates only a rotating movement of the first pulsator 200 in the same manner as a conventional pulsator, or simultaneously generates both the rotating movement and a vertical movement due to the rotating movement of the second pulsator 300, thereby generating complex water currents and thus allowing the washing machine 1 to effectively wash the laundry with only a small amount of water.

Figure 15:
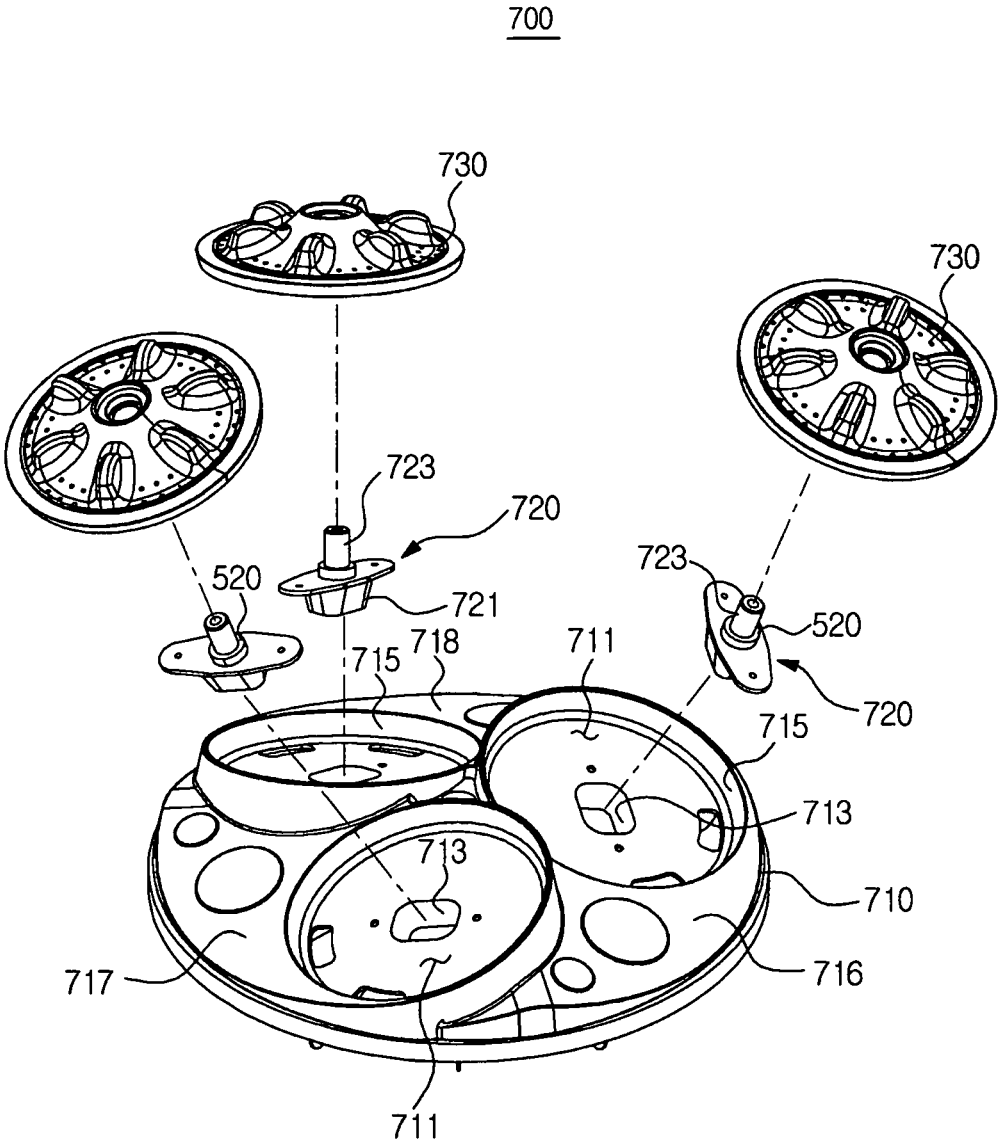
FIG. 15 is an exploded perspective view illustrating a pulsator device in accordance with a further embodiment.

FIG. 15 is an exploded perspective view illustrating a pulsator device in accordance with a further embodiment. Some parts in this embodiment which have the same functions as those in the previous embodiments are thus denoted by the same reference numerals even though they are depicted in different drawings, and a detailed description thereof will thus be omitted because it is considered to be unnecessary.

With reference to FIG. 15, a plurality of recesses 711 is formed on the upper surface of a first pulsator 710, and a side wall 715 is formed around each of the recesses 711.

The recesses 711 are respectively provided on planes 716, 717, and 718 formed on the upper surface of the first pulsator 710, and the planes 716, 717, and 718 are inclined at different angle with respect to the horizontal plane. Such a first pulsator 710 has an approximately tetrahedral shape due to the inclined planes 716, 717, and 718 on the upper surface of the first pulsator 710.

A second pulsator 730 is received in each of the plural recesses 711. The second pulsators 730 are connected with the first pulsator 710 through connectors 720 connected to the recesses 711.

A connection protrusion 721 is provided on the lower portion of the connector 720, and a shaft 723 having a biaxial inclination angle structure is provided on the upper portion of the connector 720.

The shaft 723 has the biaxial inclination angle structure having designated inclination angles in directions of the X-axis and the Y-axis on an X-Y plane parallel with the bottom of the recess 711.

A connection hole 713 to which the connection protrusion 721 of the connector 720 is connected by press fit is provided on the recess 711. The second pulsator 730 is rotatably connected to the shaft 723.

Thereby, the washing machine further improves washing ability and reduces water consumption through complex currents of wash water in the spin basket 30 generated by the first pulsator 710 and the plural second pulsators 730.

Although not shown in this embodiment, a clutch unit to intermit rotation of the second pulsator 730 so as to rotate the second pulsator 730 only in one direction may be provided on the shaft 723.

As is apparent from the above description, a washing machine in accordance with one embodiment effectively washes laundry with a small amount of water using a pulsator device generating complex water currents, thereby being advantageous in terms of washing performance and water consumption.

Although a few embodiments have been shown and described, it would be appreciated by those skilled in the art that changes may be made in these embodiments without departing from the principles, and spirit of the invention, the scope of which is defined in the claims and their equivalents.

What is claimed is:

1. A pulsator device for washing machines comprising:

a first pulsator rotated around a rotary shaft;

a shaft fixed to the first pulsator so as to revolve around the rotary shaft, and rotated together with a rotation of the first pulsator; and a second pulsator rotatably connected to the shaft, wherein the shaft is disposed so as to have a biaxial inclination angle structure in an X-axis direction and a Y-axis direction with respect to an X-Y plane perpendicular to the rotary shaft, and wherein the first pulsator includes a recess formed on an upper portion thereof, and the second pulsator is disposed in the recess, the recess being eccentrically disposed in a radial direction of the first pulsator.

2. The pulsator device according to claim 1, wherein the shaft is disposed at a position eccentric from the rotary shaft to one side, and is inclined upward toward an outside of the pulsator device in a radial direction of the first pulsator.

3. The pulsator device according to claim 1, wherein an upper end of a side wall forming the recess is disposed adjacent to an outer circumferential surface of the second pulsator.

4. The pulsator device according to claim 1, further comprising a connector fixed to an upper surface of the first pulsator so as to be rotated together with the rotation of the first pulsator, wherein the connector includes an inclined plane perpendicular to the shaft, and the shaft is extended so as to be perpendicular to the inclined plane.

5. The pulsator device according to claim 1, further comprising a clutch unit to intermit rotation of the second pulsator relative to the shaft according to a rotating direction of the second pulsator.

6. The pulsator device according to claim 5, wherein the clutch unit includes a clutch spring which is wound and unwound according to the rotating direction of the second pulsator.

7. The pulsator device according to claim 5, wherein the clutch unit includes a one-way clutch installed between the shaft and the second pulsator so as to cause the second pulsator to be rotated in any one direction out of the clockwise direction and the counterclockwise direction.

8. The pulsator device according to claim 5, wherein the clutch unit includes a latch structure to restrict rotation of the second pulsator, if the second pulsator is rotated in a first direction, and to allow the second pulsator to be rotated, if the second pulsator is rotated in an opposite direction to the first direction.

9. The pulsator device according to claim 8, wherein:

the latch structure includes at least one latch protrusion, and at least one forward and backward supported by an elastic member and moving member moving forwards and backwards; and the latch structure restricts rotation of the second pulsator through latching of the at least one forward and backward moving member to the at least one latch protrusion, if the second pulsator is rotated in the first direction, and releases the restriction of the second pulsator through application of pressure from the at least one latch protrusion to the at least one forward and backward moving member, if the second pulsator is rotated in the opposite direction to the first direction.

10. A washing machine comprising:

a first pulsator rotated around a rotary shaft;

a shaft connected to the first pulsator so as to be rotated together with a rotation of the first pulsator, and inclined;

a second pulsator rotatably connected to the shaft so as to be rotated in a first direction and in a second direction opposite to the first direction; and a clutch unit to intermit rotation of the second pulsator so as to cause the second pulsator to be rotated in any one direction out of the first direction and the second direction, and wherein the first pulsator includes a recess formed on an upper portion thereof, and the second pulsator is disposed in the recess, the recess being eccentrically disposed in a radial direction of the first pulsator.

11. The washing machine according to claim 10, wherein the shaft is inclined with respect to the rotary shaft.

12. The washing machine according to claim 10, wherein the shaft is inclined upward toward an outside of the washing machine in a radial direction of the first pulsator.

13. The washing machine according to claim 10, wherein the shaft is disposed at a position eccentric from a center of rotation of the first pulsator.

14. The washing machine according to claim 10, further comprising a connector disposed between the first pulsator and the second pulsator, and fixed to the first pulsator so as to be rotated together with the rotation of the first pulsator, wherein the connector includes an inclined plane perpendicular to the shaft, and the shaft is extended perpendicularly from the inclined plane.

15. The washing machine according to claim 10, wherein the clutch unit includes a clutch spring wound so as to restrict rotation of the second pulsator, if the second pulsator is rotated in the first direction, and unwound so as to release the restriction of the second pulsator, if the second pulsator is rotated in the second direction.

16. The washing machine according to claim 10, wherein the clutch unit includes a one-way clutch installed between the shaft and the second pulsator.

17. The washing machine according to claim 10, wherein the clutch unit includes a latch structure including at least one latch protrusion, and at least one forward and backward moving member moving forwards and backwards by an elastic member, so that the at least one latch protrusion and the at least one forward and backward moving member restrict each other, if the second pulsator is rotated in the first direction, and release the restriction, if the second pulsator is rotated in the second direction.

18. A pulsator device for washing machines comprising:

a first pulsator rotated around a rotary shaft in a regular direction and a reverse direction;

a second pulsator selectively rotated according to a rotating direction of the first pulsator, and a shaft connected to the first pulsator so as to be rotated together with a rotation of the first pulsator, and inclined, wherein the second pulsator is rotatably connected to the shaft, and wherein the first pulsator includes a recess formed on an upper portion thereof, and the second pulsator is disposed in the recess, the recess being eccentrically disposed in a radial direction of the first pulsator.

19. The pulsator device according to claim 18, further comprising a clutch unit to restrict rotation of the second pulsator relative to the shaft, if the first pulsator is rotated in any one direction out of the regular direction and the reverse direction.

20. The pulsator device according to claim 19, wherein the second pulsator is rotated integrally with the first pulsator to form a rotating water current, if a rotation of the second pulsator is restricted, and performs a rotating movement to form a vertical water current during the rotation of the first pulsator, if the restriction of the rotation of the second pulsator is released.

* * * * *

UNITED STATES PATENT AND TRADEMARK OFFICE

CERTIFICATE OF CORRECTION

PATENT NO. : 9,194,071 B2
APPLICATION NO. : 13/064764
DATED : November 24, 2015
INVENTOR(S) : Dong Pil Seo et al.

It is certified that error appears in the above-identified patent and that said Letters Patent is hereby corrected as shown below:

ON THE TITLE PAGE

Item 75, Column 1, Line 6

Delete “Hwanseong-si” and insert -- Hwaseong-si --, therefor.

Signed and Sealed this
Twenty-ninth Day of March, 2016

Michelle K. Lee

Michelle K. Lee
*Director of the United States Patent and Trademark Office*